US007922174B2

(12) United States Patent
Panides et al.

(10) Patent No.: US 7,922,174 B2
(45) Date of Patent: Apr. 12, 2011

(54) VACUUM TRANSPORT DEVICE WITH NON-UNIFORM BELT HOLE PATTERN

(75) Inventors: Elias Panides, Whitestone, NY (US); Ruddy Castillo, Briarwood, NY (US)

(73) Assignee: Xerox Corporation, Norwalk, CT (US)

( * ) Notice: Subject to any disclaimer, the term of this patent is extended or adjusted under 35 U.S.C. 154(b) by 135 days.

(21) Appl. No.: 12/407,004

(22) Filed: Mar. 19, 2009

(65) Prior Publication Data

US 2010/0238249 A1 Sep. 23, 2010

(51) Int. Cl.
*B65H 5/02* (2006.01)

(52) U.S. Cl. ..... 271/276; 271/275; 198/471.1; 198/689.1

(58) Field of Classification Search ..... 271/275, 271/276, 194, 196, 197; 198/471.1, 689.1
See application file for complete search history.

(56) References Cited

U.S. PATENT DOCUMENTS

| | | | | |
|---|---|---|---|---|
| 4,298,277 | A * | 11/1981 | Silverberg | 355/76 |
| 5,564,693 | A * | 10/1996 | Elkis et al. | 271/276 |
| 6,406,017 | B1 * | 6/2002 | Yaneda | 271/276 |
| 6,409,332 | B1 * | 6/2002 | Yraceburu et al. | 347/104 |
| 6,497,522 | B2 * | 12/2002 | Wotton et al. | 400/578 |
| 6,873,821 | B2 | 3/2005 | Russel et al. | |
| 7,182,334 | B2 | 2/2007 | Spence et al. | |
| 7,207,558 | B2 * | 4/2007 | Edinger | 271/197 |
| 7,293,770 | B2 * | 11/2007 | Edinger | 271/276 |

* cited by examiner

*Primary Examiner* — Kaitlin S Joerger
(74) *Attorney, Agent, or Firm* — Gibb I.P. Law Firm, LLC

(57) ABSTRACT

An apparatus comprises a vacuum belt having belt edges and a contact surface between the belt edges. The contact surface is adapted to contact sheets of print media and the sheets of print media have sheet edges and a central sheet region. The contact surface has a central belt region located where the central sheet region of the sheets of print media contacts the contact surface of the vacuum belt. The contact surface has border regions located where the sheet edges of the sheets of print media contact the contact surface of the vacuum belt. The central belt region is located between the border regions. The contact surface has vacuum holes, and the vacuum holes comprise an irregular pattern, such that a different density of holes is located within the border regions relative to the central belt region.

20 Claims, 4 Drawing Sheets

VACUUM TRANSPORT DEVICE WITH NON-UNIFORM BELT HOLE PATTERN

BACKGROUND AND SUMMARY

Embodiments herein generally relate to electrostatic printers and copiers or reproduction machines, and more particularly, concern a vacuum belt used within a printing device that has an irregular pattern of holes.

Direct-to-paper printing architectures require precise and robust media handling, particularly for applications where the proximity of the printhead(s) necessitates that the media is flat everywhere, including the edges, to avoid damaging the printhead(s). In view of this, a vacuum transport system is presented which uses a belt with a non-uniform hole pattern and an alignment unit that places the media onto specific locations on the vacuum belt. With this approach, unlike conventional vacuum transport systems, it is possible to capture and hold flat media whose edges are creased or curled (above a certain limit of creasing or curling).

More specifically, embodiments herein comprise a printing apparatus that includes a printing engine (e.g., an electrostatic and xerographic printing engine) and a media path. The media path transports sheets of print media relative to the printing engine. Further, the printer includes a vacuum belt within the media path and a vacuum plenum adjacent the vacuum belt. Embodiments herein can also include an alignment unit within the media path.

The vacuum belt has belt edges and a contact surface between the belt edges. The contact surface contacts sheets of print media. The sheets of print media have sheet edges (e.g., usually 4, for rectangular sheets) and a central sheet region.

The contact surface of the vacuum belt has a central belt region located where the central sheet region of the sheets of print media contacts the contact surface of the vacuum belt. Also, the contact surface has border regions located where the sheet edges of the sheets of print media contact the contact surface of the vacuum belt. The central belt region is located between (and can be surrounded by) the border regions. For example, the border regions can comprise one or more rectangles of differing sizes, which may or may not be nested within each other.

The contact surface has vacuum holes and the vacuum plenum draws air in through the vacuum holes. The vacuum holes comprise an irregular (non-uniform) pattern, because a different density of holes is located within the border regions relative to the central belt region. For example, the density of the vacuum holes can be higher in the border regions relative to the central belt region and/or the vacuum holes can be smaller or larger in the border regions relative to the central belt region The alignment unit can adjust the position of the sheets in a two-dimensional space (X-Y coordinates) within the sheet path relative to the position and timing of the contact surface such that the sheet edges of the sheets of print media are positioned on the border regions of the contact surface as the sheets are moved by the vacuum belt.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
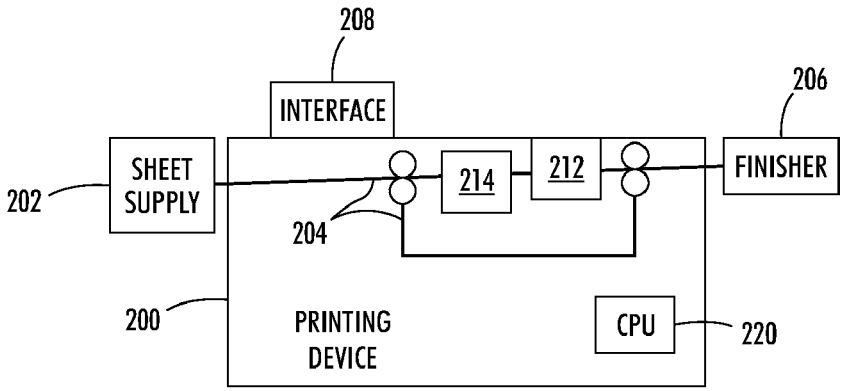
FIG. 1 is a schematic diagram of a printing device according to embodiments herein.

As mentioned above, direct-to-paper printing architectures require precise and robust media handling, particularly for applications where the proximity of the printhead(s) necessitates that the media is flat everywhere, including the edges, to avoid damaging the printhead(s). This application presents a vacuum transport system that uses a belt with a non-uniform hole pattern and an alignment unit that places the media onto specific locations on the vacuum belt. With this approach, unlike conventional vacuum transport systems, it is possible to capture and hold flat media whose edges are creased or curled (above a certain limit of creasing or curling).

Conventional vacuum transport systems employ a belt with a uniform hole pattern such that the transported media is held down by vacuum pressure. However, if the edges of the media are not flat (i.e., curled or creased) the edges will not be held down flat because the vacuum pressure of holes that are exposed to ambient conditions is zero. This situation results in decreased operating vacuum pressure over the distance from the uncovered or partially covered holes to the nearest holes completely covered by the media.

Further, merely increasing the number of holes everywhere on the belt is not a practical solution because that would increase the leakage airflow to the point where adequate vacuum pressure could not be maintained. In order to address these issues, the present embodiments reduce the number of holes in the inner region of the media and increase the number of the holes near the edges. This provides a non-uniform hole pattern outlining the various media sizes and an alignment unit for positioning the media onto the appropriate location on the belt. The present system provides precise and robust media handling for direct-to-paper architectures, ensuring that media edges are captured and kept flat throughout by using a higher density of vacuum holes (where the vacuum holes are closer together) along the border regions of the vacuum belt (where the edges of the sheets will be located).

By using a higher density of vacuum holes in the border regions, the vacuum force in the edge regions is increased (by the larger volume of air) and the distance between the last hole that is fully covered by the sheet and the edge of the sheet is decreased. A vacuum hole that is uncovered or partially covered will exert little or no vacuum force against the sheet, and the amount of sheet material between the last fully covered hole and the edge of the sheet is the portion of the media sheet that is most likely to lift off the belt. With embodiments herein, the full vacuum force is being applied closer to the edge of the sheet because the embodiments herein increase the density of the vacuum holes near the edges of the sheet (e.g., the embodiments herein decrease the spacing between the vacuum holes on the belt in this limited region). In other words, because the vacuum holes are closer together near the sheet edges, there is less sheet edge material that is subject to zero vacuum force (less material that is free to move off the belt) which decreases the likelihood that the sheet edge will lift off the belt.

More specifically, FIG. 1 illustrates a printing apparatus 200 that includes a printing engine 212 (e.g., an electrostatic and xerographic printing engine) and a media path 204. The media path 204 transports sheets of print media to and from (relative to) the printing engine 212 (e.g., from a sheet supply 202, through an alignment unit 214, through the printing engine 212, and finally to a finisher 206). Item 208 illustrates the user interface and item 210 represents the processor (central processing unit (CPU)). The processor is a computerized device and includes at least one computer storage media that stores instructions that the processor 210 executes to control the operations of the various components within the printer 200.

Figure 2:
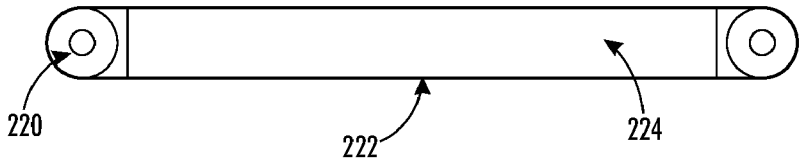
FIG. 2 is a cross-sectional schematic diagram of a vacuum belt and vacuum plenum.

As shown in greater detail in FIG. 2, the printer 200 includes a vacuum belt 222 within the media path 204, for example in the region of the printing engine 212. and a vacuum plenum 224 adjacent the vacuum belt 222. The plenum (in the cavity formed by the belt 222 and the two rollers 220) is open on one side and closed on the other side, such that vacuum suction is enabled on one surface of the transport only. The vacuum side of the plenum can have holes or grooves, or it could be made of a porous metal.

The belt 222 can be formed of any suitable material including any combination of plastic, polymer, rubber, metals, alloys, cloth, etc. and is supported by various rollers 220. Note that the belt 222, sheets, rollers, etc. illustrated in the drawings are not necessarily drawn to scale so as to allow clear illustration of the salient features of the embodiments herein. The details regarding vacuum belts and associated structures are well known to those ordinarily skilled in the art and are discussed in, for example, U.S. Pat. Nos. 5,548,388 and 4,589,651, the complete disclosures of which are incorporated herein by reference.

The belt 222 should have a non-smooth surface with an appropriate roughness given the media that will be processed. This will ensure a uniform vacuum pressure well within the edges of the media in which case the pressure operates over the entire area of the media and thus produces the greatest hold-down force. Otherwise, if the belt 222 is very smooth and/or the media is porous, the vacuum pressure is localized only near the belt holes so that the operating area and hold-down force are much less.

Figure 3:
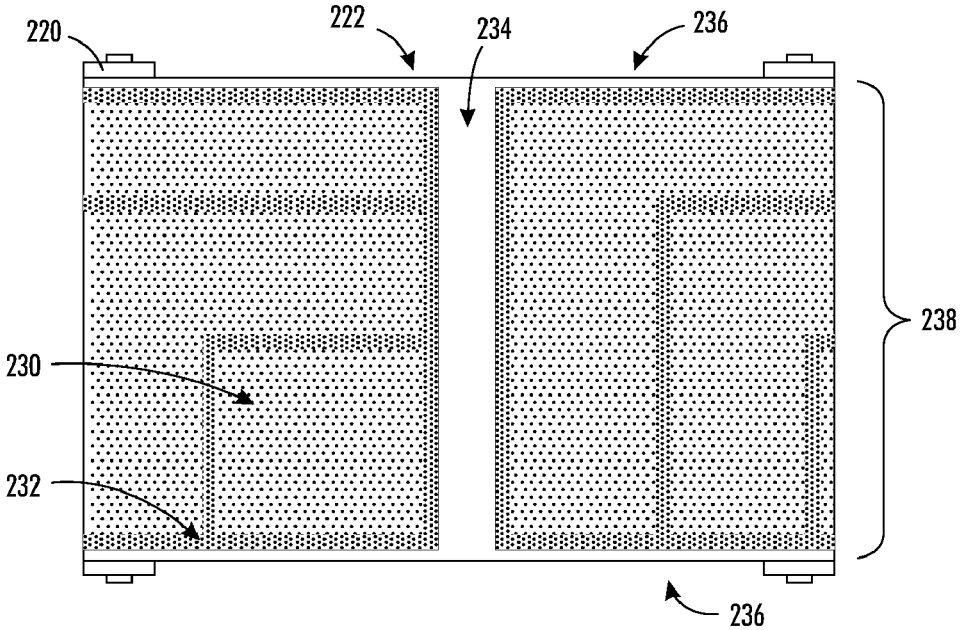
FIG. 3 is a top-view schematic diagram of a vacuum belt according to embodiments herein.
Figure 4:
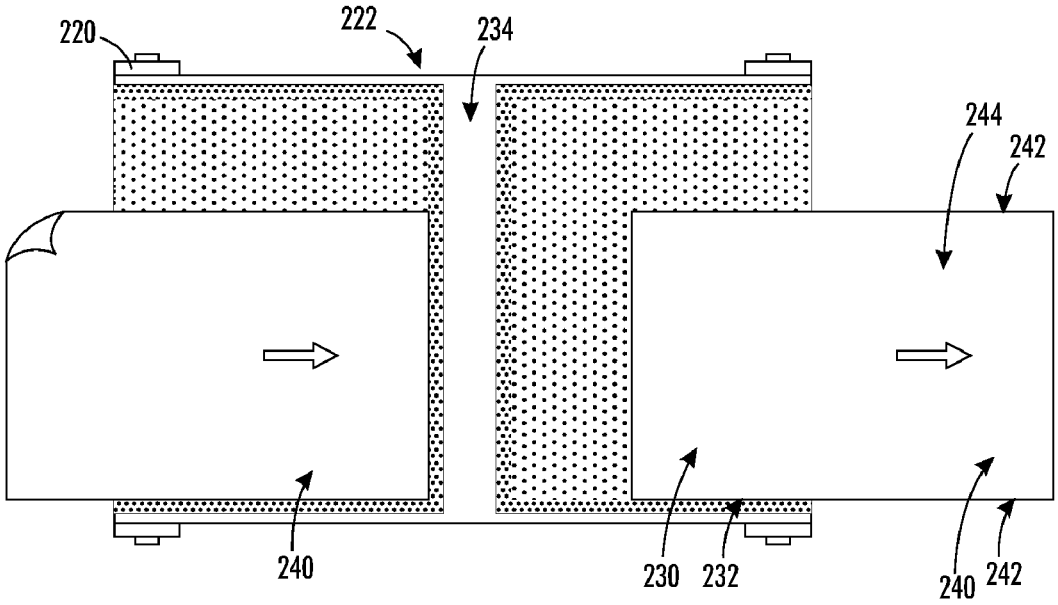
FIG. 4 is a top-view schematic diagram of a vacuum belt transporting sheets of media according to embodiments herein.

As shown in FIG. 3, the vacuum belt 222 has belt edges 236 and a contact surface 238 between the belt edges 236. As shown in FIG. 4, the contact surface 238 contacts sheets of print media 240. Item 234 illustrates the inter document gap of the vacuum belt 222, which does not contain vacuum holes (because it is not intended to make contact with any of the sheets of print media 240).

The sheets of print media 240 have sheet edges 242 (e.g., usually 4, for rectangular sheets) and a central sheet region 244. One ordinarily skilled in the art would understand that the sheets 240 could be any shape and have many different numbers of edges (e.g., could be triangular, hexagonal, curved, etc.) and that rectangular sheets are utilized in the drawings only as examples.

Figure 5:
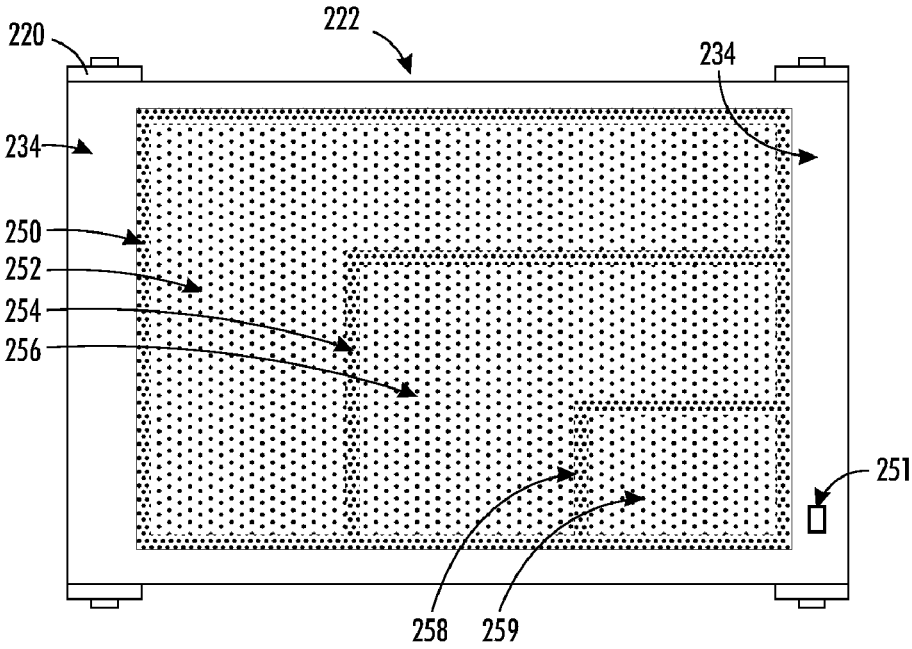
FIG. 5 is a top-view schematic diagram of a vacuum belt according to embodiments herein.
Figure 6:
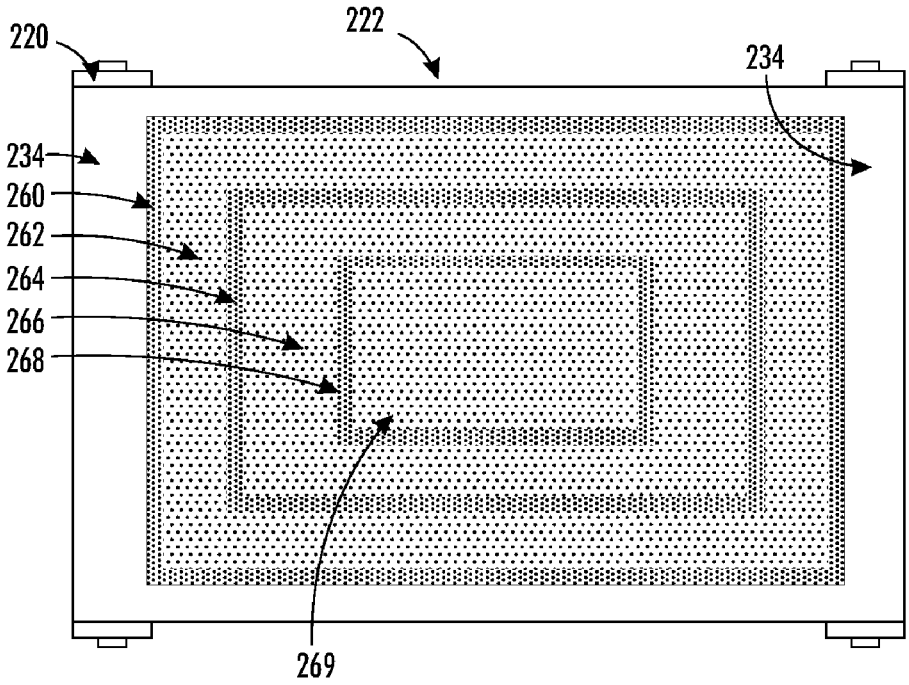
FIG. 6 is a top-view schematic diagram of a vacuum belt according to embodiments herein.
Figure 7:
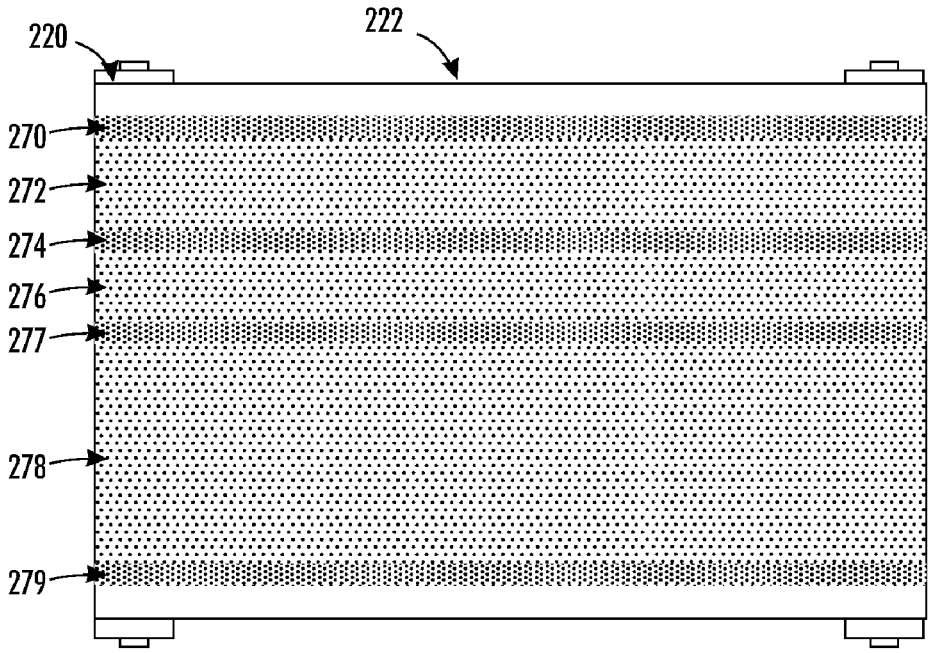
FIG. 7 is a top-view schematic diagram of a vacuum belt according to embodiments herein.

As shown in FIGS. 3 and 4, the contact surface 238 of the vacuum belt 222 has a central belt region 230 located where the central sheet region 244 of the sheets of print media 240 contacts the contact surface 238 of the vacuum belt 222. Also, the contact surface 238 has border regions 232 located where the sheet edges 242 of the sheets of print media 240 contact the contact surface 238 of the vacuum belt 222. The central belt region 230 is located between (and can be surrounded by) the border regions 232. For example, the border regions 232 can comprise one or more rectangles of differing sizes, which may or may not be nested within each other. The border regions 232 have widths that are smaller than the width of the contact belt regions 230. For example, the border regions width can be less than 25%, less than 10%, less than 5%, less than 1% of the width of the contact belt region. Additional examples of other border regions are illustrated in FIGS. 5-7, discussed below.

In operation, a single sheet of paper 240 enters (from the left) and is inserted to the leading edge of the border region 232 hole pattern (for one pitch) which is a band of high hole density. The band is sufficiently wide so as to require only coarse placement of that sheet 240 within the width of the high hole density band 232. As the sheet 240 exits (to the right) the border region 232 hole pattern (for this pitch) moves to the lower part of the transport where the plenum is closed and is thus de-activated.

The contact surface 238 has vacuum holes (represented by the dots in FIGS. 3-7) and the vacuum plenum 224 draws air in through the vacuum holes. As shown in FIGS. 3-7, the vacuum holes comprise an irregular (non-uniform) pattern, because a different density of vacuum holes is located within the border regions 232 relative to the central belt region 230. For example, the density of the vacuum holes can be higher (e.g., 125%, 150%, 175%, 200%, 300%, etc.) in the border regions 232 relative to the central belt region 230 and/or the vacuum holes can be smaller (e.g., 90%, 80%, 75%, 50%, 25%, 10%, etc.) or larger (e.g., 125%, 150%, 175%, 200%, 300%, etc.) in the border regions 232 relative to the central belt region 230. By changing the density and/or the size of the holes within the border regions 232 (relative to the central belt region 230) the vacuum force is increased within the border regions 232 (relative to the central belt region 230).

The alignment unit 214 can adjust the position of the sheets 240 in a two-dimensional space (X-Y coordinates) within the sheet path 204 relative to the position and timing of the contact surface 238 such that the sheet edges 242 of the sheets of print media 240 are positioned on the border regions 232 of the contact surface 238 as the sheets are moved by the vacuum belt 222.

More specifically, the alignment unit 214 can contain rollers, guides, etc. that position the sheets between the belt edges 236 to align the sheet edges 242 with the border regions 232. Further, the alignment unit 214 can contain rollers, gates, etc. that will delay the delivery of the sheets 240 until the leading and trailing edges of the sheets 240 can be aligned with the border regions 232 on the contact surface 238 of the vacuum belt 222. Therefore, by adjusting the position of the sheets 240 between the belt edges 236, the alignment unit 214 adjusts the paper within the X-coordinate, and by adjusting the timing of when the sheet 240 is placed on the moving vacuum belt 222, the alignment unit adjusts the paper within the Y-coordinate.

In some embodiments, an auxiliary belt hole or other mark 251 can be used in conjunction with a sensor to determine the position of the belt 222 and help with the insertion and placement of the leading edge of the oncoming sheet on the leading edge of the hole pattern of the corresponding border region.

In this manner, the alignment unit 214 can position the sheets 240 so that all the sheet edges 242 (the four sheet edges illustrated in FIG. 4) are placed upon corresponding border regions 232. As noted above, the border regions 232 will exert greater vacuum force than the central belt region 230 which helps hold the sheet edges 242 down against the vacuum belt 222. This helps maintain the sheets 240 flat on the vacuum belt 222, even if the sheets are curled or creased, or the sheet edges 242 have some other feature that tends to raise the sheets 240 up off the belt 222.

The hole pattern of the border regions 232 is established to correspond to the various media sizes and the alignment unit places the media onto the hole pattern on the vacuum belt 222 that is appropriate for the media size of the sheet being transported. The non-uniform belt hole pattern illustrated in the drawings is such that when the media is placed on the belt 222, many more holes are near the edges of the media. For example, FIG. 5 illustrates three nested rectangles; the first being defined by border region 250 and including central regions 252, 256, and 259; the second being defined by border region 254 and including central regions 256 and 259; and the third being defined by border region 258 and including central region 259. The pattern of border regions illustrated in FIG. 5 is substantially similar to the examples shown in FIGS. 3 and 4.

Similarly, FIG. 6 illustrates three commonly centered (concentric) nested rectangles; the first being defined by border region 260 and including central regions 262, 266, and 269; the second being defined by border region 264 and including central regions 266 and 269; and the third being defined by border region 268 and including central region 269.

While the border region patterns illustrated in FIGS. 3-6 are useful with rectangular sheets having predetermined length and width dimensions, FIG. 7 is useful with sheets that do not necessarily have predetermined lengths. More specifically, FIG. 7 illustrates linear border regions 270, 274, 277, and 279 which define linear central regions 272, 276, and 278. Therefore, the border regions illustrated in FIG. 7 are useful with at least three different widths of paper that may have variable lengths.

While FIGS. 3-7 illustrate a few different patterns of border regions, those ordinarily skilled in the art would understand that the present embodiments are not limited to these specific patterns. Instead, all embodiments herein are intended to encompass all situations where the border regions have a shape that corresponds to the shape of the sheets that the vacuum belt will accommodate. Thus, the border regions can be rectangular, triangular, hexagonal, rounded, or any other shape necessary to accommodate the shape of the media being supplied. Thus, the embodiments herein are applicable to any patterns of border regions that change the density and/or holes size near the sheet edges to allow increased vacuum force near the sheet edges.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The word "printer" or "image output terminal" as used herein encompasses any apparatus, such as a digital copier, bookmaking machine, facsimile machine, multi-function machine, etc. which performs a print outputting function for any purpose. The embodiments herein specifically applied to any direct-to-paper technology (xerographic, inkjet, etc.). The details of printers, printing engines, etc., are well-known by those ordinarily skilled in the art and are discussed in, for example, U.S. Patent Publication 2008/0061499, the complete disclosure of which is fully incorporated herein by reference. While FIG. 8 describes an electrophotographic printing machine, those ordinarily skilled in the art would understand that the present embodiments are equally applicable to any form of printing machine, whether now known or developed in the future. For example, the embodiments herein are especially applicable to direct printing architectures including inkjet-based printing, ribbon-based printing, etching, etc. For a full discussion of one example of direct printing architectures see U.S. Patent Publication Number 2009/0009573 and the patents and publications listed therein (the complete disclosures of which are incorporated herein by reference).

Figure 8:
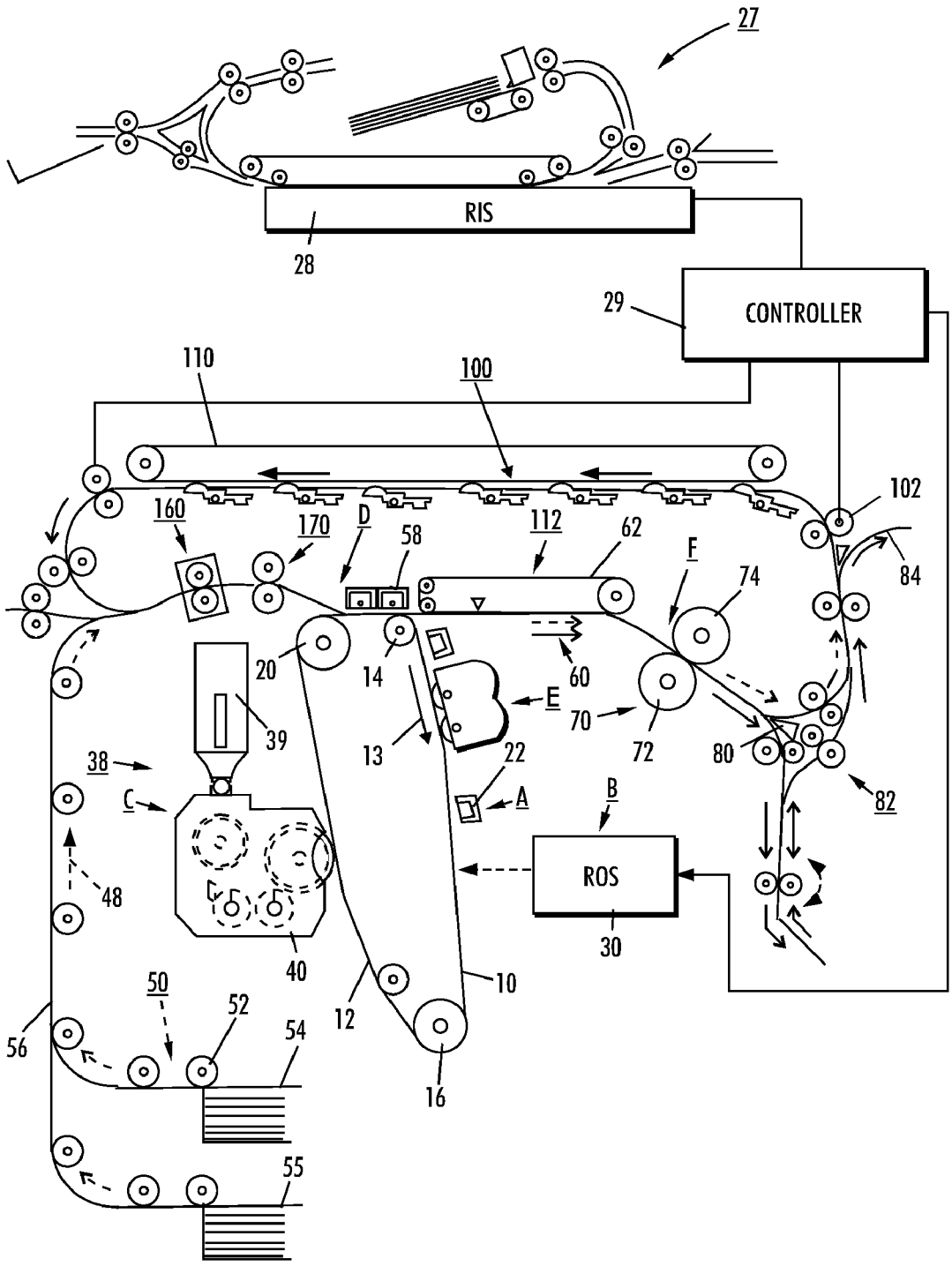
FIG. 8 is a schematic diagram of a printing device according to embodiments herein.

For example, FIG. 8 schematically depicts an electrophotographic printing machine that is similar to one described in U.S. Patent Publication 2008/0061499. It will become evident from the following discussion that the present embodiments may be employed in a wide variety of devices and is not specifically limited in its application to the particular embodiment depicted in FIG. 8.

FIG. 8 schematically depicts an electrophotographic printing machine incorporating the features of the present disclosure therein. It will become evident from the following discussion that the device of the present disclosure may be employed in wide variety of devices and is not specifically limited in its application to the particular embodiments depicted herein. For example, the apparatus of the present disclosure can be used in document handlers, if desired.

FIG. 8 illustrates an original document positioned in a document handler 27 on a raster input scanner (RIS) indicated generally by the reference numeral 28. The document handler 27 can include the vacuum belt 222 as discussed above. The RIS contains document illumination lamps; optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 8 schematically illustrates an electrophotographic printing machine, which generally employs a photoconductive belt 10. Preferably, the photoconductive belt 10 is made from a photoconductive material coated on a grounded layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example, a raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by raster basis.

After the electrostatic latent image has been recorded on photoconductive surface 12, belt 10 advances the latent image to a development station C, where toner, in the form of liquid or dry particles, is electrostatically attracted the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 8, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a feed rolls 52 and 53 contacting the uppermost sheet of stacks 54 and 55, respectively. Feed roll 52 rotates to advance the uppermost sheet from stack 54 into vertical transport 56. Vertical transport 56 directs the advancing sheet 48 of support material into pre-registration device 160 which in conjunction with stalled roll registration mechanism 170 moves a now registered sheet 48 past image transfer station D to receive an image from photoreceptor belt 10 in a timed sequence so that the toner powder image formed thereon contacts the advancing sheet 48 at transfer station D. The vertical transport 56 can comprise a vacuum belt 222 that is discussed above. Transfer station D includes a corona generating device 58, which sprays ions onto the back side of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roll 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 210, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor, which controls the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. An apparatus comprising:

a vacuum belt having belt edges and a contact surface between said belt edges, said contact surface being adapted to contact sheets of print media, said sheets of print media having sheet edges and a central sheet region, said contact surface having a central belt region located where said central sheet region of said sheets of print media contacts said contact surface of said vacuum belt, said contact surface having border regions located where said sheet edges of said sheets of print media contact said contact surface of said vacuum belt, said central belt region being located between said border regions, said central belt region and said border regions having vacuum holes, and said vacuum holes comprising an irregular pattern, such that a different density of holes is located within said border regions relative to said central belt region.

2. The apparatus according to claim 1, a density of said vacuum holes being higher in said border regions relative to said central belt region.

3. The apparatus according to claim 1, said vacuum holes being a different size in said border regions relative to said central belt region.

4. The apparatus according to claim 1, said border regions comprising a rectangle.

5. The apparatus according to claim 1, said border regions comprising at least two rectangles of differing sizes.

6. A printing apparatus comprising:

a printing engine;

a media path transporting sheets of print media relative to said printing engine;

a vacuum belt within said media path; and a vacuum plenum adjacent said vacuum belt, said vacuum belt having belt edges and a contact surface between said belt edges, said contact surface being adapted to contact sheets of print media, said sheets of print media having sheet edges and a central sheet region, said contact surface having a central belt region located where said central sheet region of said sheets of print media contacts said contact surface of said vacuum belt, said contact surface having border regions located where said sheet edges of said sheets of print media contact said contact surface of said vacuum belt, said central belt region being located between said border regions, said central belt region and said border regions having vacuum holes, said vacuum plenum drawing air in through said vacuum holes, and said vacuum holes comprising an irregular pattern, such that a different density of holes is located within said border regions relative to said central belt region.

7. The printing apparatus according to claim 6, a density of said vacuum holes being higher in said border regions relative to said central belt region.

8. The printing apparatus according to claim 6, said vacuum holes being a different size in said border regions relative to said central belt region.

9. The printing apparatus according to claim 6, said border regions comprising a rectangle.

10. The printing apparatus according to claim 6, said border regions comprising at least two rectangles of differing sizes.

11. A printing apparatus comprising:

a printing engine;

a media path transporting sheets of print media relative to said printing engine;

a vacuum belt within said media path;

a vacuum plenum adjacent said vacuum belt; and an alignment unit within said media path, said vacuum belt having belt edges and a contact surface between said belt edges, said contact surface being adapted to contact sheets of print media, said sheets of print media having sheet edges and a central sheet region, said contact surface having a central belt region located where said central sheet region of said sheets of print media contacts said contact surface of said vacuum belt, said contact surface having border regions located where said sheet edges of said sheets of print media contact said contact surface of said vacuum belt, said central belt region being located between said border regions, said central belt region and said border regions having vacuum holes, said vacuum plenum drawing air in through said vacuum holes, said vacuum holes comprising an irregular pattern, such that a different density of holes is located within said border regions relative to said central belt region, and said alignment unit positioning said sheet edges of said sheets of print media on said border regions of said contact surface.

12. The printing apparatus according to claim 11, a density of said vacuum holes being higher in said border regions relative to said central belt region.

13. The printing apparatus according to claim 11, said vacuum holes being a different size in said border regions relative to said central belt region.

14. The printing apparatus according to claim 11 said border regions comprising a rectangle.

15. The printing apparatus according to claim 11, said border regions comprising at least two rectangles of differing sizes.

16. A printing apparatus comprising:

a printing engine;

a media path transporting sheets of print media relative to said printing engine;

a vacuum belt within said media path;

a vacuum plenum adjacent said vacuum belt; and an alignment unit within said media path, said vacuum belt having belt edges and a contact surface between said belt edges, said contact surface being adapted to contact sheets of print media, said sheets of print media having four sheet edges and a central sheet region, said contact surface having a central belt region located where said central sheet region of said sheets of print media contacts said contact surface of said vacuum belt, said contact surface having border regions located where said sheet edges of said sheets of print media contact said contact surface of said vacuum belt, said central belt region being located between said border regions, said contact surface having vacuum holes, said vacuum plenum drawing air in through said vacuum holes, said vacuum holes comprising an irregular pattern, such that a different density of holes is located within said border regions relative to said central belt region, and said alignment unit positioning said sheets in a two-dimensional space within said sheet path relative to said contact surface such that said four sheet edges of said sheets of print media are positioned on four of said border regions of said contact surface.

17. The printing apparatus according to claim 16, a density of said vacuum holes being higher in said border regions relative to said central belt region.

18. The printing apparatus according to claim 16, said vacuum holes being a different size in said border regions relative to said central belt region.

19. The printing apparatus according to claim 16, said border regions comprising at least two rectangles of differing sizes.

20. The printing apparatus according to claim 16, said printing engine comprising one of an electrostatic and xerographic printing engine.

* * * * *